United States Patent [19]

Corwin

[11] 4,263,485

[45] Apr. 21, 1981

[54] KEYBOARD OF MEMBRANE SWITCHES WITH TACTILE FEEDBACK

[75] Inventor: William C. Corwin, La Grange, Ill.

[73] Assignee: Beckman Instruments, Inc., Fullerton, Calif.

[21] Appl. No.: 84,936

[22] Filed: Oct. 15, 1979

[51] Int. Cl.[3] ..... H01H 3/12; H01H 9/04; H01H 13/06

[52] U.S. Cl. ..... 200/5 A; 200/159 B; 200/292; 200/302

[58] Field of Search ..... 200/5 A, 5 R, 86 R, 200/159 B, 275, 292, 308, 314, 317, 302

[56] References Cited

U.S. PATENT DOCUMENTS

| | | | |
|---|---|---|---|
| 3,591,749 | 7/1971 | Comstock | 200/308 |
| 3,808,384 | 4/1974 | Boulanger | 200/159 B X |
| 4,086,451 | 4/1978 | Boulanger | 200/5 A |

*Primary Examiner*—J. V. Truhe
*Assistant Examiner*—Richard M. Moose
*Attorney, Agent, or Firm*—Robert J. Steinmeyer; Paul R. Harder; Edward C. Jason

[57] ABSTRACT

A keyboard type switch is disclosed wherein a domed snap disc performs triatic functions of acting as a tactile feedback source for switch operation, of supplying a conductive path for electrical energy when depressed, and of providing a contact surface for manual operation. The disclosed switch is covered by a multilayered nonconductive membrane and spacer to provide maximum safety from electrical shock to the operator.

5 Claims, 4 Drawing Figures

KEYBOARD OF MEMBRANE SWITCHES WITH TACTILE FEEDBACK

BACKGROUND OF THE INVENTION

The prior art has taught many configurations of keyboard type switches. A keyboard type switch is inexpensive by nature, due to low current and voltage levels it must switch and minimal emphasis on durability. However, prior art switches each have individual disadvantages together with a common disadvantage.

The basic principle of a keyboard type switch is very simple. There are two electrodes which in their normal or steady state are not connected, that is there is no conductive path between them. In operation, a pushbutton associated with a conductive strip is depressed to urge the conductive strip in position to establish a conductive path between electrodes for a brief period. An additional element, such as a spring, or the configuration of the conductive strip returns the switch to its steady state with the electrodes electrically separated. The rapid contact between electrodes permits an electrical signal to be fed to a microprocessor, solid state memory or the like to key a response. The magnitude of the electrical energy is, in general, very low both in current and voltage.

Individual disadvantages center around the means for returning the conductive strip that bridges the electrodes to its steady state or its normal condition. Some prior art keyboard type switches have used additional springs to urge the conductive strip to its steady state position. However, additional springs can create problems through misalignment. Furthermore, additional springs add cost to the keyboard type switch both in materials and in manufacturing labor man-hours.

The majority of prior art keyboard type switches have eliminated additional springs by configuring the conductive strip to remain in its steady state position and relying on the inherent resiliency of metal to act as a spring to return the conductive strip to its normal condition. Unfortunately, prior art switches which rely upon the resiliency of the conductive strip have a deficiency in the limited spring life of the metal strip and its slow action attributable to a low spring constant.

The limited spring life is due to operating motion being concentrated on a small area of the conductive strip. Moderate use weakens the area of concentration since a metal strip may be bent, even slightly, only a limited number of times. A low spring constant is due also to operation being concentrated on a small area of the conductive strip. The spring constant will be based upon the thickness and the quality of material of the conductive strip. Both factors add cost to the switch to increase the spring constant, which is increased only for a limited time since, as indicated above, the spring weakens with each use.

A general deficiency of prior art switches is that an actuator button is necessary to urge the conductive strip to bridge the electrodes. An actuator button adds material and labor cost to the switch since it is an additional part which is not only added but must be aligned. Furthermore, actuator buttons can accumulate dirt, grease, etc., in depressions and corners associated with a pushbutton. Accumulations of dirt and grease can render keyboard type switches inoperative or, in the alternative, unsuitable for certain uses, such as in the sterile environment of a hospital. Prior Art has attempted to overcome this deficiency by using a single membrane to cover a plurality of switches as described in U.S. Pat. No. 4,086,451 to Henry J. Boulanger. A typical prior art keyboard utilizing a single membrane to cover a plurality of switches is illustrated in FIG. 1.

FIG. 1 depicts a prior art keyboard 2 having a single layered membrane 4 covering a plurality of switches designated by numbered boxes 6. While a single layered membrane may prevent the accumulation of dirt and grease, graphics such as numbers must be placed on either side of the membrane and are subject to wear.

It is therefore an object of the present invention to provide a less expensive keyboard type switch.

It is also an object of the present invention to provide a keyboard type switch which will not accumulate dirt and grease.

It is a further object of the present invention to provide a keyboard type switch requiring no additional urging means to return electrical contacts to their normal steady state position.

It is also a further object of the present invention to provide a simple keyboard switch that overcomes the abovementioned deficiencies of prior art keyboards and keyboard type switches.

SUMMARY OF THE INVENTION

A keyboard type switch having its normal steady state position with contacts open is provided wherein a conductive domed metal snap disc bridging the electrical contacts is configured to have its own resiliency returning it to its normal steady state position. The metal disc bridging the electrical contacts is covered with a multi-layered laminar coating with a nonconductive spacer placed therebetween.

DESCRIPTION OF THE PREFERRED EMBODIMENT

Figure 3:
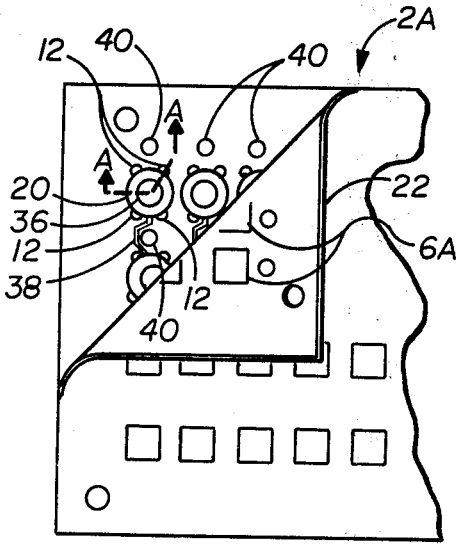
FIG. 3 is a top view of a keyboard similar to that of FIG. 1 incorporating the present invention with a portion of the multilayered laminar covering peeled back.
Figure 2:
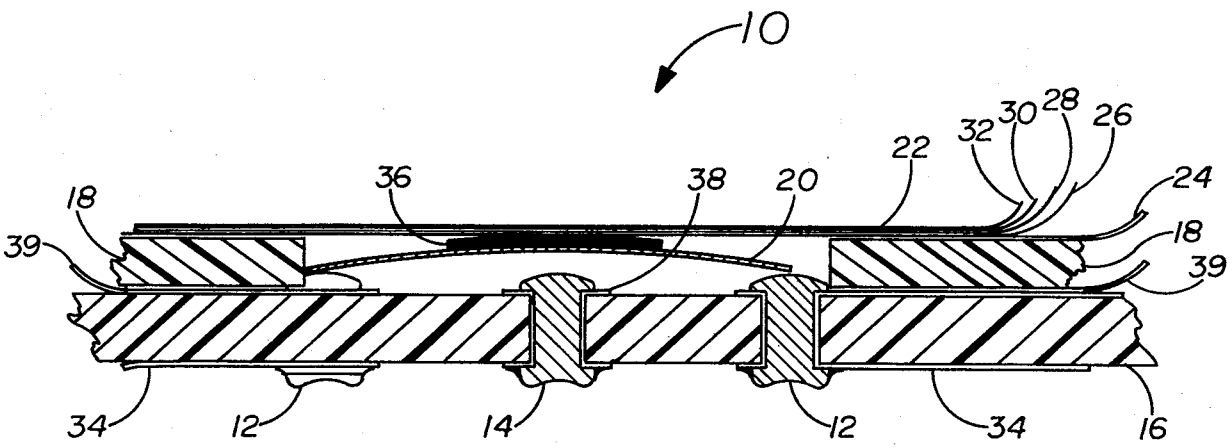
FIG. 2 is a sectional view of a switch taken along lines A—A of FIG. 3.

Referring to FIG. 2, a sectional view of switch 10 taken along lines A—A of FIG. 3 is illustrated as having electrical contacts 12 and 14 electrically isolated by a support means 16, which may be any type of non-conductive substrate. Mounted upon support means 16 is a layer of insulating material 18 having at least one hole in which a conductive disc 20 rests on electrical contacts 12. As shown from above in FIG. 3 and in cross-section in FIG. 2, portions of the circumference of the hole in layer 18 may be cut away or provided with an annular groove in order to allow electrical contact 12 to project above the surface of support 16 while layer 18 is resting flat on the surface thereof. Covering insulating material 18 is laminar sheet 22 having layers 24, 26, 28, 30 and 32. Establishing a permanent electrical conductive path between contacts 12 is printed circuit solder 34. Solder 34 also establishes electrical contact between contacts 12 and one terminal of an electrical circuit (not shown) to be operated by switch 10. Mounted between conductive disc 20 and laminar sheet 22 is spacer 36. Printed circuit solder 38 establishes electrical contact between another terminal of the electrical circuit to be operated by switch 10 and electrical contact 14.

Figure 4:
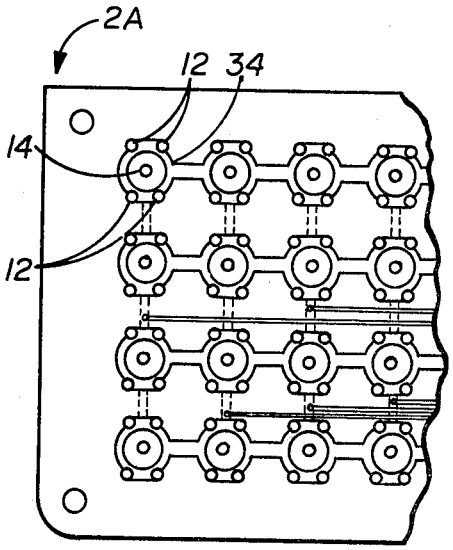
FIG. 4 is a bottom view of the keyboard of FIG. 3.

Support means 16 is an epoxy and fiber glass board having printed circuit solder 34 and 38 on either side (see FIGS. 3 and 4). Electrical contacts 12 and 14 are preferably gold plated rivets mounted in plated through holes in support means 16 and soldered on their flared side. However, any type of conductive contacts may be used as long as they are constructed in such a manner as to provide a high point to permit "rocking". "Rocking" occurs when disc 20 is depressed and its edges slide outwardly and up in rocking type fashion. Conductive disc 20 rests on contacts 12 having its edge resting on the tip of the domed rivet comprising electrical contact 12 so that the rocking action allows the disc to snap properly.

Conductive disc 20 is preferably a 0.004 inch thick disc made of spring temper 302 stainless steel with a tinsel and yield strength in excess of 200,000 pounds per square inch. The disc is preferably gold plated 0.000050 inches thick. The gold plating is preferably located on the underside of disc 20 at points which come in contact with electrical contacts 12 and 14. Disc 20 of the preferred embodiment preferably snaps when pushed by the operator's finger with a force of about 10 to 14 ounces and reverts to its original shape when the force is reduced to four to six ounces but always before the force is reduced to zero. Return of disc 20 to its steady state or normal position prior to reduction of the external force to zero provides tacticle feedback by forcing the operator's fingers back while it is still exerting a forward pressure.

Spacer 36 is preferably placed at the center of conductive disc 20 and is preferably 0.005 inches thick having a quarter inch diameter and is held on with adhesive material such as glue. A Brady quick dot made of non conductive material is preferred to add further electrical isolation between the current carrying disc 20 and the operator. Spacer 36 also acts to mechanically amplify the force of the tactile feedback of disc 20 in returning to its normal state. Insulating material 18 is preferably a punched polyvinyl chloride or similar plastic layer approximately 0.030 inches thick and held onto support means 16 with a transfer film adhesive 39 or the like.

Laminar sheet 22 consists of a layer 30 of silk screen graphics underneath the surface film 32 preferably made of a polyester or similar solvent resistant plastic. Polyester film 32 is laminated to an additional polyester film 26 with a layer of heat sensitive glue 28 to protect the graphics film 30 from any abrasion from spacer disc 36. Laminated polyester film 26 is held in place on insulating material 18 by a layer of transfer film adhesive 24.

In actual operation, a keyboard operator wishing to establish electrical contact between electrical contacts 12 and 14 pushes against laminar surface 22 at a point approximately above electrode 14. The pressure on the surface of laminar sheet 22 is transmitted through spacer disc 36 to conductive disc 20 which then will come in contact with electrode 14. Thus, an electrically conductive path is established between electrodes 12 and electrode 14 through conductive disc 20 which establishes electrical contact between terminals of an electrical circuit (not shown) to be actuated by switch 10 attached to electrical contacts 12 and electrical contact 14, respectively. To open electrical contact between electrical contacts 12 and electrical contact 14, the operator merely has to release pressure on laminar surface 22. When pressure is decreased and not necessarily zero as previously described, conductive disc 20 returns to its normal steady state position which is resting on the tips of domed rivets which comprise electrical contact 12 while being removed spatially from electrical contact 14.

Figure 1:
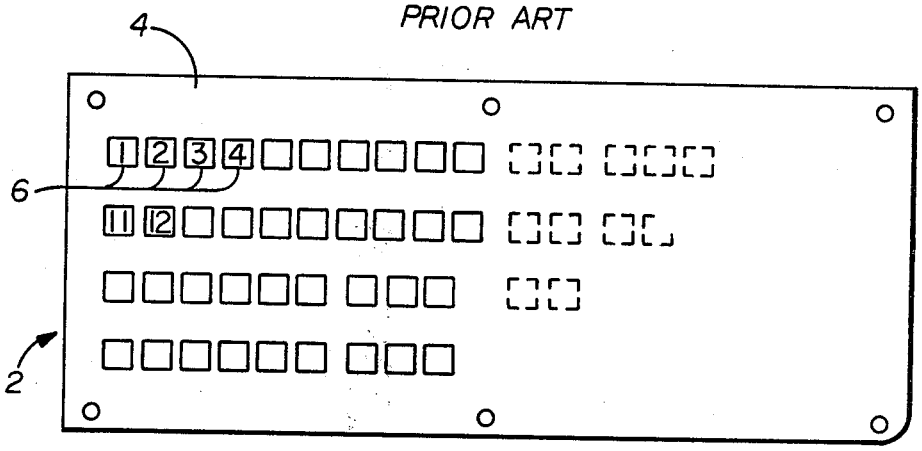
FIG 1 PRIOR ART
FIG. 1 is a top view of a typical prior art smooth surface keyboard.

Referring now to FIG. 3, a top view of a keyboard similar to that of FIG. 1 is illustrated with laminar surface 22 partially peeled back to illustrate a matrix of keyboard type switches illustrated in FIG. 2. A keyboard 2A is illustrated as having provisions, such as cutouts 40, associated with each keyboard type switch for accepting light emitting diodes or the like as indicators that that particular switch has been selected.

FIG. 4 illustrates the bottom view of the keyboard of FIG. 3 more specifically indicating printed circuit board connections 34 as being a common connection for one line of switches 10 set up in a matrix pattern. the spatial relationship between contact 12 and contact 14 for each switch is illustrated showing the preferred clearances for low electrical energy switching. However, one skilled in the art can easily modify the spatial relationships of the electrical contacts without departing from the scope of the present invention.

Thus, the present invention provides a keyboard type switch that overcomes the problem of dirt and grease accumulation of typical keyboard type switches by covering a plurality of switches with a single multilayered membrane. The problem of wear of switch identifications is overcome by providing laminar coatings on both sides of a graphics sheet. Electrical shock is prevented by the multilayered membrane covering a conductive disc bridging the contacts of the switch. The problem of multiple moving parts for switch actuation is overcome by providing a single conductive domed snap disc which not only provides a conductive path between electrical contacts but also operates to return itself to a normal steady state condition of "contacts open". The domed snap disc further operates in conjunction with a nonconductive multilayered membrane covering as the operator contact point providing tactile feedback through the construction of the disc. A nonconductive spacer may be provided between the membrane and the disc to add further electrical isolation between the operator and the conductive disc and to provide mechanical amplification of the inherent tactile feedback of the domed snap disc.

While the present invention has been described as a preferred embodiment, it is to be understood that the description is for illustration purposes only and the present invention should not be limited thereto but only by the scope of the following claims.

What is claimed is:

1. A keyboard type switch comprising:

support means for providing a mounting surface;

first electrical contact mounted on said support means;

second electrical contact mounted on said support means;

domed shaped conductive disc having a first state for establishing an electrical conductive path between said first electrical contact and said second electrical contact and a second state for providing an open circuit between said first and said second electrical contact and providing tactile feedback when transitioning between said first state and said second state;

an insulating layer mounted on said support means, said layer having a hole for receiving said disc and maintaining said disc in contact with said first electrical contact;

laminar means covering said conductive disc and connected to said insulating layer; and spacer means connected to said conductive disc for amplifying tactile feedback from said conductive disc.

2. A keyboard type switch of claim 1 wherein said conductive disc comprises a 0.004 inch thick disc made of spring temper 302 stainless steel.

3. A keyboard type switch of claim 1 wherein said laminar means comprises a first layer, a second layer, and a third layer, said first layer comprises a polyester plastic film, said second layer comprises a silk screen graphics plastic layer and said third layer comprises a polyester plastic film.

4. A keyboard type switch as set forth in claim 1 in which said second electrical contact comprises a domed rivet, and in which said first electrical contact comprises a plurality of domed rivets circumferentially disposed with respect to said second electrical contact.

5. A keyboard type switch as set forth in claim 4 in which the shape of said domed conductive disc is such that the depression of the center of the disc affords an outward and upward sliding contact between said disc and said circumferentially disposed rivets.

* * * * *